US008016098B2

(12) United States Patent
Saiia

(10) Patent No.: US 8,016,098 B2
(45) Date of Patent: Sep. 13, 2011

(54) SNOWTHROWER BELT-DRIVEN CHUTE ROTATION SYSTEM

(76) Inventor: Brian P. Saiia, Milwaukee, WI (US)

( * ) Notice: Subject to any disclaimer, the term of this patent is extended or adjusted under 35 U.S.C. 154(b) by 224 days.

(21) Appl. No.: 12/365,104

(22) Filed: Feb. 3, 2009

(65) Prior Publication Data

US 2010/0193322 A1 Aug. 5, 2010

(51) Int. Cl.
*E01H 5/02* (2006.01)

(52) U.S. Cl. ..... 198/640; 198/641; 37/261

(58) Field of Classification Search ..... 198/640, 198/641; 37/260

See application file for complete search history.

(56) References Cited

U.S. PATENT DOCUMENTS 3,303,588 A * 2/1967 Krause ..... 37/250
3,583,084 A * 6/1971 Farrell ..... 37/245
3,780,455 A * 12/1973 Stevenson et al. ..... 37/261
4,255,879 A * 3/1981 Greider ..... 37/245
4,409,748 A * 10/1983 Westimayer ..... 37/261
5,444,927 A * 8/1995 Sosenko ..... 37/260
6,718,746 B2 * 4/2004 Hettiger et al. ..... 56/11.7
6,952,893 B1 * 10/2005 Sanderson ..... 37/261
7,165,345 B2 * 1/2007 Beaudoin ..... 37/261
7,703,223 B2 * 4/2010 Walker et al. ..... 37/260

* cited by examiner

*Primary Examiner* — Mark A Deuble
(74) *Attorney, Agent, or Firm* — Greenburg Traurig, LLP

(57) ABSTRACT

Embodiments of the invention provide a belt-driven chute rotation system for a snowthrower having a chute and an engine. The chute rotation system includes a chute rotation mechanism rotating the chute around a first axis of rotation. The chute rotation system includes an actuation mechanism having a belt and at least one pulley. The belt moves substantially continuously when the engine is running. The at least one pulley moves from a first position adjacent to the belt to a second position engaging the belt. The at least one pulley is coupled to the chute rotation mechanism.

21 Claims, 4 Drawing Sheets

SNOWTHROWER BELT-DRIVEN CHUTE ROTATION SYSTEM

BACKGROUND

Snowthrowers include a chute that discharges snow collected by an auger. The chute rotates with respect to a main section of the snowthrower in order to direct the snow to either side of the snowthrower. Manually rotating the chute can be tiresome, especially if the direction of the chute must be changed frequently. To rotate the chute, some snowthrowers include electrical motors activated by push buttons. Due to the wet and cold weather conditions in which snowthrowers operate, electrical motors are often not as durable and reliable as desired.

SUMMARY

Embodiments of the invention provide a belt-driven chute rotation system for a snowthrower having a chute and an engine. The chute rotation system includes a chute rotation mechanism rotating the chute around a first axis of rotation. The chute rotation system includes an actuation mechanism having a belt and at least one pulley. The belt moves substantially continuously when the engine is running. The at least one pulley moves from a first position adjacent to the belt to a second position engaging the belt. The at least one pulley is coupled to the chute rotation mechanism.

DETAILED DESCRIPTION

Figure 2:
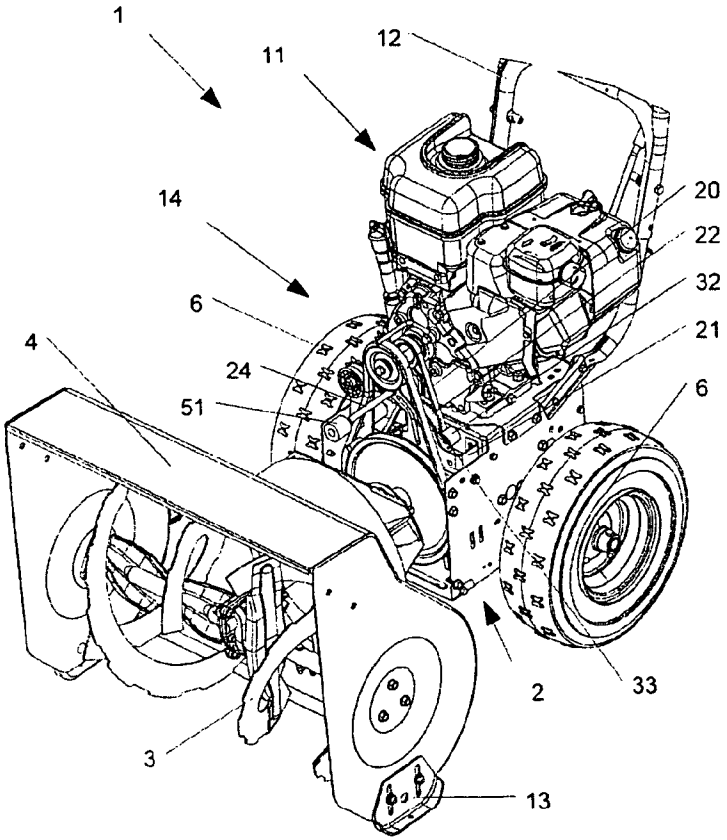
FIG. 2 is a perspective view of the snowthrower of FIG. 1 with the chute rotation system exposed.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 1:
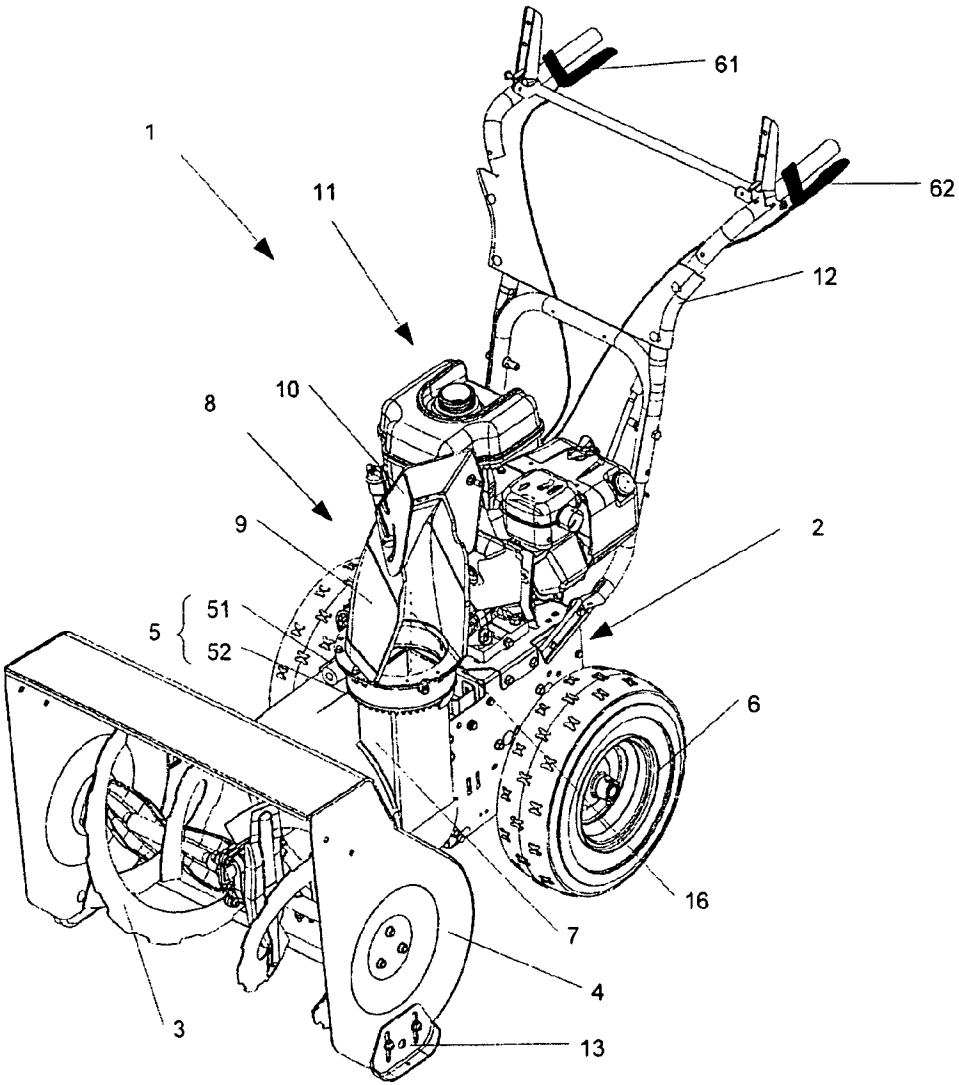
FIG. 1 is a perspective view of a snowthrower including a chute rotation system according to one embodiment of the invention.

FIG. 1 illustrates a snowthrower 1 including a main body 2, an auger 3, a shield 4, a chute rotation mechanism 5, wheels 6, a channel 7, and a chute 8. The chute 8 includes a main body 9 and a deflector 10. The snowthrower 1 also includes an engine 11, handlebars 12, and a stop. The stop 13 can be mounted to the shield 4 to help prevent the rotating auger 3 from damaging the surfaces being cleared, for example, driveways and sidewalks. The shield 4 can direct snow collected by the auger 3 toward the channel 7. The channel 7 can lead to the chute 8, which can be rotated by the chute rotation mechanism 5.

Figure 3:
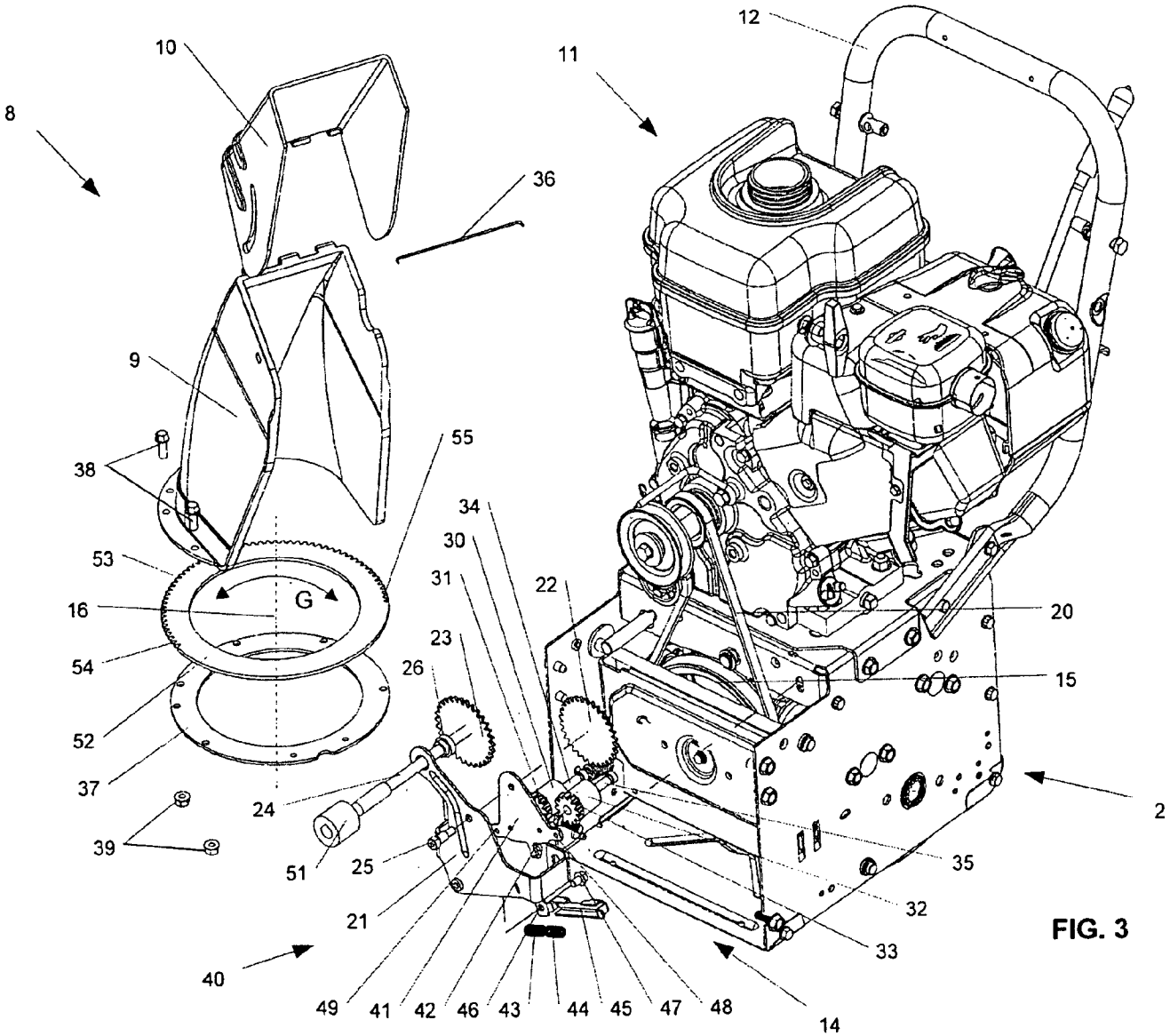
FIG. 3 is an exploded view of the chute rotation system of FIG. 2.

In FIG. 2, the channel 7 and the chute 8 are removed to more clearly illustrate an actuation mechanism 14 according to one embodiment of the invention. FIGS. 2 and 3 illustrate both the actuation mechanism 14 and the chute rotation mechanism 5. As shown in FIG. 3, the chute rotation mechanism 5 can rotate the chute 8 around a first axis of rotation 16 in one of two directions (i.e., clockwise or counterclockwise). The actuation mechanism 14 can control the chute rotation mechanism 5.

As shown in FIG. 3, the actuation mechanism 14 can include a drive pulley 15, a belt 20, a bracket 21, a first spur gear 22, a second spur gear 23, a rod 24, a fastener 25, a bushing 26, a first pulley 30, a second pulley 32, a first integrated gear 31, a second integrated gear 33, fasteners 34 and 35, and a centering mechanism 40. The deflector 10 can be mounted to the main body 9 of the chute 8 by a pin 36.

In order to control the chute rotation mechanism 5, the actuation mechanism 14 can selectively engage the belt 20. The belt 20 can be move substantially continuously when the engine 11 is running. The auger 3 and the wheels 6 can be operated by the engine 11 independently of the belt 20 (e.g., with separate clutches, not shown). In this manner, the actuation mechanism 14 can control the chute rotation mechanism 5 even when the auger 3 is not rotating and the snowthrower 1 is not collecting snow.

Figure 5:
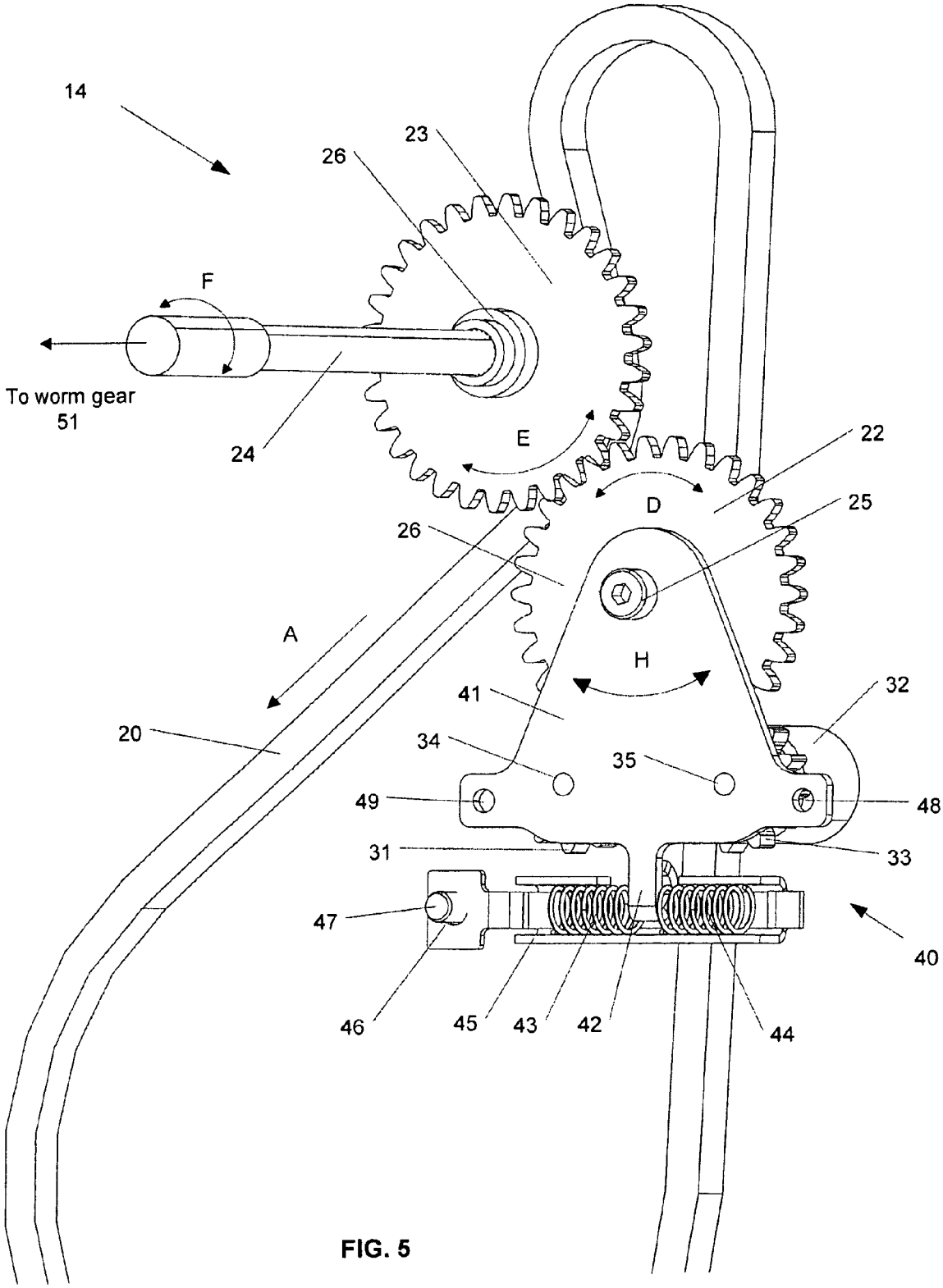
FIG. 5 is a back perspective view of the actuation mechanism of FIG. 4.

As shown in FIGS. 3 and 5, the centering mechanism 40 can include a plate 41 having an extension 42, a first spring 43, a second spring 44, a housing 45 having an opening 46, and a fastener 47. The plate 41 can also include apertures 48 and 49.

As also shown in FIG. 3, the chute rotation mechanism 5 can include a worm gear 51 and a disc 52. The disc 52 can include a notched portion 53. The disc 52 can be coupled to the bottom of the main body 9 of the chute 8 by a ring 37, which can have a radius slightly smaller than the disc 52. The ring 37 can be coupled to the main body 9 with screws 38 and nuts 39. In some embodiments, no friction plates or brakes in addition to the notched portion 53 are necessary to retain the chute 8 at a desired location during operation of the snowthrower 1.

Figure 4:
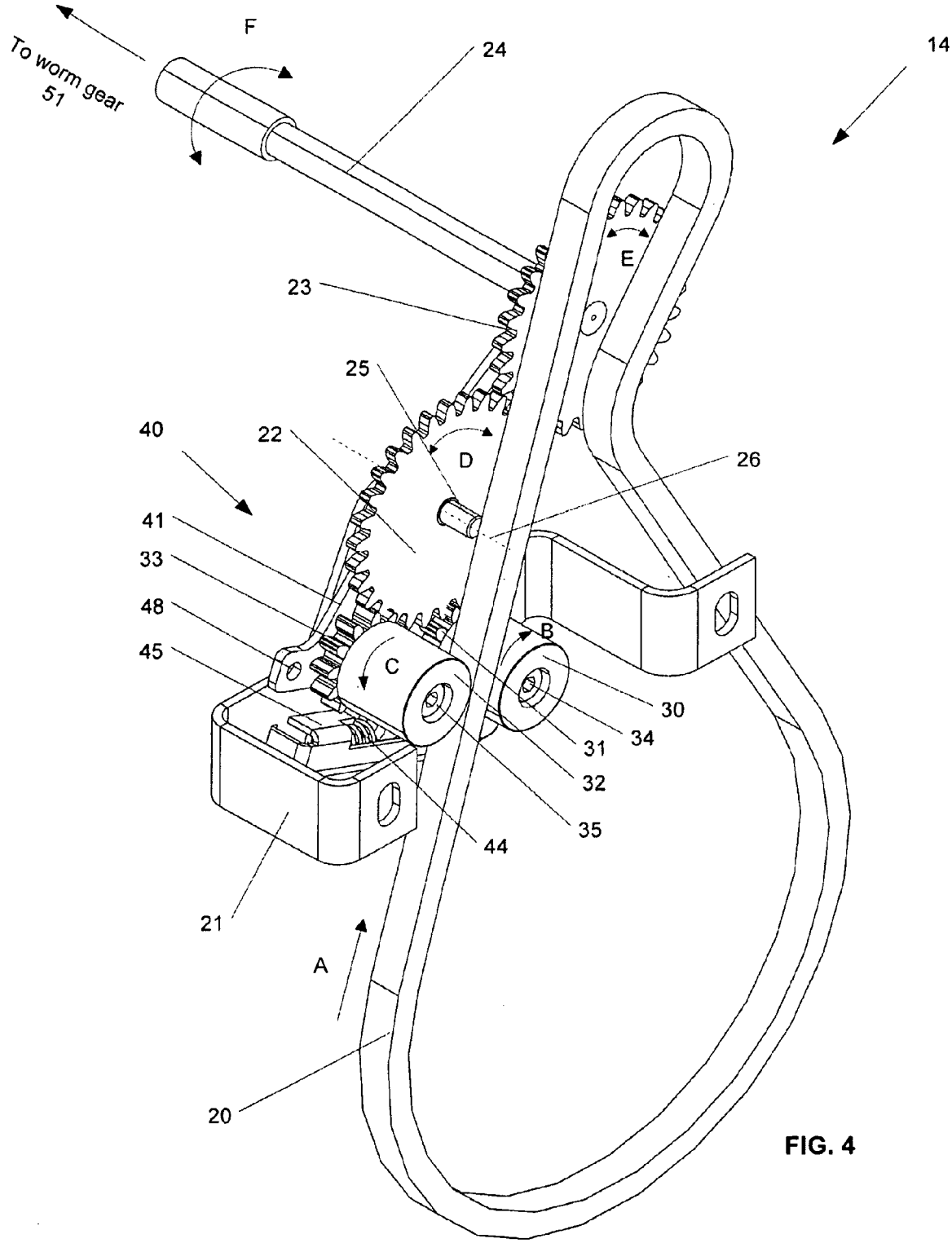
FIG. 4 is a front perspective view of an actuation mechanism of the chute rotation system of FIG. 2.

As shown in FIG. 2, the bracket 21 can be coupled to the main body 2 of the -snowthrower 1. FIG. 4 further illustrates the actuation mechanism 14, in which the bracket 21 can serve as a base to which other components of the actuation mechanism 14 can be mounted. As shown in FIG. 4, the belt 20 can rotate in a first direction (as indicated by the arrow A) when the engine 11 is running.

The centering mechanism 40 and the first spur gear 22 can be coupled to the bracket 21 by the fastener 25 so that rotational movement (as indicated by the arrow D in FIG. 5) of the first spur gear 22 is not obstructed. The first pulley 30 and the second pulley 32 can be coupled to the plate 41 by the fasteners 34 and 35, respectively. The integrated first gear 31 of the first pulley 30 and the integrated second gear 33 of the second pulley 32 can engage the first spur gear 22. The first spur gear 22 can also engage the second spur gear 23, which can be coupled to the rod 24. The rod 24 can be coupled to the worm gear 51. The second spur gear 23, the first pulley 30, and the second pulley 32 can each engage the first spur gear 22 at different locations. In addition, the second spur gear 23, the first pulley 30, and the second pulley 32 can be coupled to the first spur gear 22, even when the plate 41 is moving.

The belt 20 can move between the first pulley 30 and the second pulley 32 so that either the first pulley 30 or the second pulley 32 can engage the belt 20. If the first pulley 30 engages the belt 20, the first pulley 30 can rotate in a first direction (as indicated by the arrow B in FIG. 4) around the fastener 34, which can result in the chute 8 rotating in a first direction. If the second pulley 32 engages the belt 20, the second pulley 32 can rotate in a second direction (as indicated by the arrow C in FIG. 4) around the fastener 35, which can result in the chute 8 rotating in a second direction that is opposite to the first direction.

FIG. 5 illustrates a back view of the actuation mechanism 14 with the bracket 21 removed in order to further illustrate the centering mechanism 40. The plate 41 of the centering mechanism 40 can swivel (as indicated by the arrows H in FIG. 5) around a second axis of rotation 26 defined by the fastener 25. Depending on the direction of rotation of the plate 41, the extension 42 can engage either the first spring 43 or the second spring 44. The first spring 43 and the second spring 44 can be positioned in the housing 45. The housing 45 can be mounted to the bracket 21 by the fastener 47 through the opening 46. In one embodiment, the plate 41 can slide along a guide (not shown) to engage either the first pulley 30 or the second pulley 32.

As shown in FIG. 1, a right trigger 61 and a left trigger 62 can be mounted to the handlebars 12. An operator can actuate the right trigger 61 or the left trigger 62 in order to rotate the plate 41 of the centering mechanism 40. The right trigger 61 can be coupled to the aperture 48 of the plate 41 and the left trigger 62 can be coupled to the aperture 49 of the plate 41. In one embodiment, the chute 8 can rotate clockwise when an operator actuates the right trigger 61, while the chute 8 can rotate counterclockwise when the operator actuates the left trigger 62. Other suitable triggers (e.g., a joystick) can be used in other embodiments.

When the operator is not actuating either the right trigger 61 or the left trigger 62, the belt 20 can freely pass between the first pulley 30 and the second pulley 32. When the operator actuates the right trigger 61 or the left trigger 62, the centering mechanism 40 can rotate around the axis of rotation 26 in one of two directions (as indicated by the arrow H in FIG. 5).

As further shown in FIG. 5, either the first pulley 30 or the second pulley 32 can engage the belt 20 and can rotate around the fastener 34 or the fastener 35 in order to control the chute rotation mechanism 5. While either the first pulley 30 or the second pulley 32 engages the belt 20, the extension 42 of the plate 41 can compress the first spring 43 or the second spring 44. The force exerted by either the first spring 43 or the second spring 44 can be in an opposite direction to the force being applied to the right trigger 61 or the left trigger 62 by the operator. When either the right trigger 61 or the left trigger 62 is released, either the first spring 43 or the second spring 44 can move the plate 41 back to its default position disengaging either the first pulley 30 or the second pulley 32 and discontinuing the rotation of the chute 8.

The rotation of either the first pulley 30 or the second pulley 32 can be initiated by the belt 20 through frictional forces. The level of the frictional force between the first pulley 30 or the second pulley 32 and the belt 20 can determine the speed at which the chute 8 rotates. When either the first pulley 30 or the second pulley 32 is only in slight contact with the belt 20, the chute 8 can rotate more slowly. When one of the first pulley 30 or the second pulley 32 is in full contact with the belt 20, the chute 8 can rotate more quickly. In one embodiment, the force exerted by the first pulley 30 or the second pulley 32 against the belt 20 can be substantially proportional to the distance the right trigger 61 or the left trigger 62 moves with respect to the handlebars 12.

The chute 8 is generally not allowed to rotate a full revolution. To guard the operator from snow exiting the chute 8, the chute 8 is generally limited to a specific angle of rotation (as indicated by the arrow G in FIG. 3). In one embodiment, this limited angle of rotation (e.g., 270 degrees) can be provided by the notched portion 53 of the disc 52. The notched portion 53 can have a first end 54 and a second end 55. The notched portion 53 can limit the rotation of the chute 8 when the worm gear 51 reaches either the first end 54 or the second end 55. Additionally, if the actuation mechanism 14 drives the worm gear 51 toward either the first end 54 or the second end 55, a force limiting device (e.g., a clutch, not shown) can be used between the worm gears 51 and either the first pulley 30 or the second pulley 32. The force limiting device can help prevent further rotation of the chute 8 when the worm gear 51 has reached the first end 54 or the second end 55.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. For example, in some embodiments, a single pulley can be moved with respect to the belt 20 to rotate the chute 8 in either direction. However, a pulley is not required to rotate around an axis to engage the belt 20. Rather, a pulley or other member can slide or translate in order to engage the belt 20.

Various features and advantages of the invention are set forth in the following claims.

The invention claimed is:

1. A chute rotation system for a snowthrower including a chute, an engine, and an auger operatively coupled to the engine, the chute rotation system comprising:

a chute rotation mechanism configured and arranged to rotate the chute around a first axis of rotation; and an actuation mechanism including a belt and at least one pulley, the belt configured and arranged to move substantially continuously when the engine is running configured and arranged to move independently of the auger, the at least one pulley configured and arranged to move from a first position adjacent to the belt to a second position engaging the belt, the at least one pulley coupled to the chute rotation mechanism.

2. The system of claim 1 wherein the at least one pulley is configured and arranged to rotate around a second axis of rotation to engage the belt.

3. The system of claim 1 wherein the snowthrower includes at least one trigger configured and arranged to be actuated by an operator to apply a force to the at least one pulley.

4. The system of claim 1 wherein the at least one pulley includes a first pulley and a second pulley, wherein the first pulley is configured and arranged to rotate the chute in a first direction, and wherein the second pulley is configured and arranged to rotate the chute in a second direction.

5. The system of claim 4 wherein the actuation mechanism includes a drive pulley coupled to the engine and the belt.

6. The system of claim 5 wherein the actuation mechanism includes a first spur gear and a second spur gear.

7. The system of claim 6 wherein the first pulley includes a first integrated gear is coupled with the first spur gear, and wherein the second pulley includes a second integrated gear is coupled with the first spur gear.

8. The system of claim 7 wherein the first spur gear is coupled with the second spur gear, wherein the second spur gear is coupled to a rod, and wherein the rod is coupled to the chute rotation mechanism.

9. The system of claim 1 and further comprising a centering mechanism is configured and arranged to move the at least one pulley from the second position back to the first position.

10. The system of claim 9 wherein the centering mechanism includes a plate and at least one spring.

11. The system of claim 1 wherein the chute rotation mechanism configured and arranged to rotate the chute up to about 270 degrees.

12. The system of claim 11 wherein the chute rotation mechanism includes a disc comprising a notched portion that limits rotation of the chute.

13. The system of claim 12 wherein the chute rotation mechanism includes a worm gear, and wherein the notched portion is configured and arranged to limit rotation of the chute when the worm gear reaches one of a first end and a second end of the notched portion.

14. The system of claim 1 and further comprising a bracket coupled to a main body of the snowthrower and the actuation mechanism.

15. The system of claim 1 wherein a frictional force exerted on the belt by the at least one pulley determines a speed at which the chute rotation mechanism rotates the chute.

16. The system of claim 15 wherein the frictional force is proportional to a distance at least one trigger is moved toward a handlebar of the snowthrower.

17. A method of rotating a chute of a snowthrower including an engine and an auger operatively coupled to the engine, the method comprising:

providing a chute rotation mechanism to rotate the chute around a first axis of rotation;

providing a belt that moves substantially continuously when the engine is running and moves independently of the auger;

providing at least one pulley that is moveable from a first position adjacent to the belt to a second position engaging the belt; and coupling the at least one pulley to the chute rotation mechanism.

18. The method of claim 17 and further comprising providing at least one trigger configured to be actuated by an operator to apply a force to the at least one pulley.

19. The method of claim 17 and further comprising providing a centering mechanism configured to move the at least one pulley from the second position back to the first position.

20. The method of claim 17 and further comprising providing a disc having a notched portion configured to limit rotation of the chute to up to about 270 degrees.

21. The method of claim 17 and further comprising providing at least one trigger configured to exert a frictional force on the belt with the at least one pulley in order to determine a speed at which the chute rotation mechanism rotates the chute.

* * * * *